US011460812B2

(12) United States Patent
Taniguchi et al.

(10) Patent No.: US 11,460,812 B2
(45) Date of Patent: Oct. 4, 2022

(54) BAND AND WRIST-WORN DEVICE

(71) Applicant: SEIKO EPSON CORPORATION, Tokyo (JP)

(72) Inventors: Tsutomu Taniguchi, Shiojiri (JP); Kenichi Nakajima, Shimosuwa-machi (JP)

(73) Assignee: SEIKO EPSON CORPORATION, Tokyo (JP)

( * ) Notice: Subject to any disclaimer, the term of this patent is extended or adjusted under 35 U.S.C. 154(b) by 65 days.

(21) Appl. No.: 16/674,190

(22) Filed: Nov. 5, 2019

(65) Prior Publication Data

US 2020/0142358 A1 May 7, 2020

(30) Foreign Application Priority Data

Nov. 6, 2018 (JP) ..... JP2018-208827

(51) Int. Cl.
*A44C 5/14* (2006.01)
*G04B 37/14* (2006.01)

(52) U.S. Cl.
CPC ..... *G04B 37/1486* (2013.01); *A44C 5/14* (2013.01)

(58) Field of Classification Search
CPC ..... A44C 5/14
See application file for complete search history.

(56) References Cited

U.S. PATENT DOCUMENTS 2,820,275 A * 1/1958 Lancaster ..... G04B 37/12 224/174
3,581,960 A * 6/1971 Ojima ..... A44C 5/145 24/265 WS
3,722,040 A * 3/1973 Meyerson ..... A44C 5/14 368/282
4,432,476 A * 2/1984 Yokosuka ..... A44C 5/14 224/164
4,605,312 A * 8/1986 Sellier ..... G04B 37/1486 224/177
6,408,491 B2 * 6/2002 Guyard ..... G04B 37/1486 24/265 WS (Continued)

FOREIGN PATENT DOCUMENTS

CN 1530046 A 9/2004
JP 2004-121454 A 4/2004

(Continued)

*Primary Examiner* — Jason W San
(74) *Attorney, Agent, or Firm* — Oliff PLC

(57) ABSTRACT

A band to be attached to a wrist-worn device body including a case, a lug provided at a side face of the case, a pin supported by the lug, and an attachment face, the band including a band body, a coupler body member coupled to an end portion of the band body, the coupler body member being provided with a contact face abuttable against the attachment face and a guide groove into which the pin is insertable, and a fixing member attached to the coupler body member to be movable between a fixing position for biasing the pin, inserted into the guide groove, in a direction away from the attachment face to fix the coupler body member onto the wrist-worn device body, and an attaching-detaching position for enabling insertion of the pin into the guide groove and detachment of the pin inserted into the guide groove.

8 Claims, 13 Drawing Sheets

(56) References Cited

U.S. PATENT DOCUMENTS 7,526,840 B2 * 5/2009 Pernu ..... A44C 5/14 24/265 WS
7,575,368 B2 * 8/2009 Guillaume ..... G04B 37/1486 24/71 J
8,007,165 B1 * 8/2011 Lalo ..... G04B 37/1486 368/282
8,235,585 B2 * 8/2012 Speichinger ..... G04B 37/1486 368/282
8,662,743 B2 * 3/2014 Speichinger ..... G04B 37/1486 368/282
9,004,750 B2 * 4/2015 Tschumi ..... G04B 37/1486 368/282
9,010,593 B2 * 4/2015 Tschumi ..... G04B 37/1486 368/282
9,756,907 B2 * 9/2017 Frei ..... A44C 5/145
2001/0016971 A1 * 8/2001 Guyard ..... G04B 37/1486 24/365
2003/0035347 A1 * 2/2003 Yokosuka ..... G04B 37/1493 368/281
2004/0184358 A1 9/2004 Hiranuma et al.
2006/0261106 A1 * 11/2006 Hiranuma ..... A44C 5/14 224/178
2010/0238770 A1 * 9/2010 Speichinger ..... G04B 37/1486 368/282
2017/0164698 A1 * 6/2017 Nagahara ..... G04B 37/1486
2017/0250554 A1 * 8/2017 Tajima ..... G04G 19/00
2019/0332062 A1 * 10/2019 Grand ..... G04B 37/1486
2020/0183334 A1 * 6/2020 Rochat ..... G04B 37/1493
2022/0066398 A1 * 3/2022 Okada ..... G04G 9/0064

FOREIGN PATENT DOCUMENTS

JP 3593044 B2 11/2004
JP 3108180 U 4/2005
JP 3203156 U 3/2016

* cited by examiner

BAND AND WRIST-WORN DEVICE

The present application is based on, and claims priority from JP Application Serial Number 2018-208827, filed Nov. 6, 2018, the present disclosure of which is hereby incorporated by reference herein in its entirety.

BACKGROUND

1. Technical Field

The disclosure relates to a band and wrist-worn device.

2. Related Art

There has been known a band that can be easily attached to and detached from a case of wrist-worn devices to be attached to a wrist, such as wrist watches (e.g., US 2010/238770 A).

In US 2010/238770 A, a coupling member with a fixing member is attached to an end of the band. A side face of the case of a wrist watch is provided with a pair of protrusion portions, where a pin is disposed between the pair of protrusion portions. The coupling member is provided with a groove portion into which the pin can be inserted, where in a state where the pin is inserted into the groove portion, the fixing member is slid along the side face and the bottom face of the case. Thereby, a step portion of the fixing member moves to the fixing position at which the step portion abuts against the side face and the bottom face of the case, and the fixing member causes a spring member to bias the side face and the bottom face of the case to make the band attached to the case of a wrist watch.

In US 2010/238770 A, when attaching and detaching the band 1 to/from a wrist watch, the fixing member, which is a movable portion, is slid along the side face and the bottom face of the case. This causes the case to be scraped against the fixing member, to thus generate scratches.

SUMMARY

A band of the present disclosure is a band to be attached to a wrist-worn device body including a case, a lug provided at a side face of the case, a pin supported by the lug, and an attachment face, the band including a band body, a coupler body member coupled to an end portion of the band body, the coupler body member being provided with a contact face abuttable against the attachment face and a guide groove into which the pin is insertable, and a fixing member attached to the coupler body member to be movable between a fixing position for biasing the pin, inserted into the guide groove, in a direction away from the attachment face to fix the coupler body member onto the wrist-worn device body, and an attaching-detaching position for enabling insertion of the pin into the guide groove and detachment of the pin inserted into the guide groove are allowed.

In the band of the present disclosure, the attachment face may include the side face.

In the band of the present disclosure, the fixing member may be pivotally attached in a first direction from the attaching-detaching position toward the fixing position and a second direction from the fixing position toward the attaching-detaching position.

In the band of the present disclosure, the fixing member may include a base end member to be pivotally attached to the coupler body member, a lever member pivotally attached to the base end member and biasing the pin, and a first elastic member configured to bias the lever member to pivot in the first direction, and the lever member may be configured to bias the pin with an elastic force of the first elastic member.

In the band of the present disclosure, the fixing member may include a second elastic member configured to bias the base end member to pivot in the first direction.

In the band of the present disclosure, the base end member may include a guide portion biased by the second elastic member to come in contact with the coupler body member in a state where the pin is not inserted into the guide groove, the guide portion may include an abutting face that abuts against the pin inserted through an opening of the guide groove into the guide groove in a state where the guide portion is in contact with the coupler body member, and the abutting face, in a state where the pin abuts against the abutting face and further when the pin is inserted into the guide groove, may be inclined with respect to an insertion direction of the pin such that the base end member pivots in the second direction.

In the band of the present disclosure, the base end member may include a bearing portion into which a first shaft member that rotatably supports the base end member with respect to the coupler body member is inserted, and a coupling portion extending along an axial direction of the first shaft member, the guide portion may include a first guide portion and a second guide portion provided at a first end side and a second end side of the coupling portion and extending in a direction orthogonal to the axial direction of the first shaft member, and the lever member may be disposed between the first guide portion and the second guide portion.

In the band of the present disclosure, the fixing member may include a lever member pivotally attached to the coupler body member and configured to bias the pin, the fixing member may include a third elastic member configured to bias the lever member to pivot in the first direction, and the lever member is configured to bias the pin with an elastic force of the third elastic member.

In the band of the present disclosure, the fixing member may include a lever member pivotally attached to the coupler body member and configured to bias the pin, and the lever member may be made elastically deformable when coming in contact with the pin at the fixing position to bias the pin with an elastic force of the lever member.

The band of the present disclosure may include a surface member attached to a surface of the coupler body member.

A wrist-worn device of the present disclosure includes a wrist-worn device body including a case, a lug provided at a side face of the case, a pin supported by the lug, and an attachment face, a band body attached to the wrist-worn device body, a coupler body member coupled to an end portion of the band body, the coupler body member being provided with a contact face abuttable against the attachment face and a guide groove into which the pin is insertable, and a fixing member attached to the coupler body member to be movable between a fixing position for biasing the pin, inserted into the guide groove, in a direction away from the attachment face to fix the coupler body member onto the wrist-worn device body, and an attaching-detaching position for enabling insertion of the pin into the guide groove and detachment of the pin inserted into the guide groove.

A wrist-worn device of the present disclosure includes a wrist-worn device body including a case, a lug provided at a side face of the case, an elastic pin supported by the lug and being elastically deformable in a direction intersecting an axial direction, and an attachment face, a band body attached to the wrist-worn device body, a coupler body member coupled to an end portion of the band body, the coupler body member being provided with a contact face abuttable against the attachment face and a guide groove into which the pin is insertable, and a fixing member attached to the coupler body member to be movable between a fixing position at which the elastic pin inserted into the guide groove biases the fixing member in a direction closer to the attachment face to fix the coupler body member, and an attaching-detaching position for enabling insertion of the elastic pin into the guide groove and detachment of the elastic pin inserted into the guide groove.

DESCRIPTION OF EXEMPLARY EMBODIMENTS

First Exemplary Embodiment

Hereinafter, a watch 100 according to the first embodiment of the present disclosure is described below with reference to drawings of FIGS. 1 to 7. Note that the watch 100 is an example of a wrist-worn device to be worn on the wearer's wrist.

Figure 1:
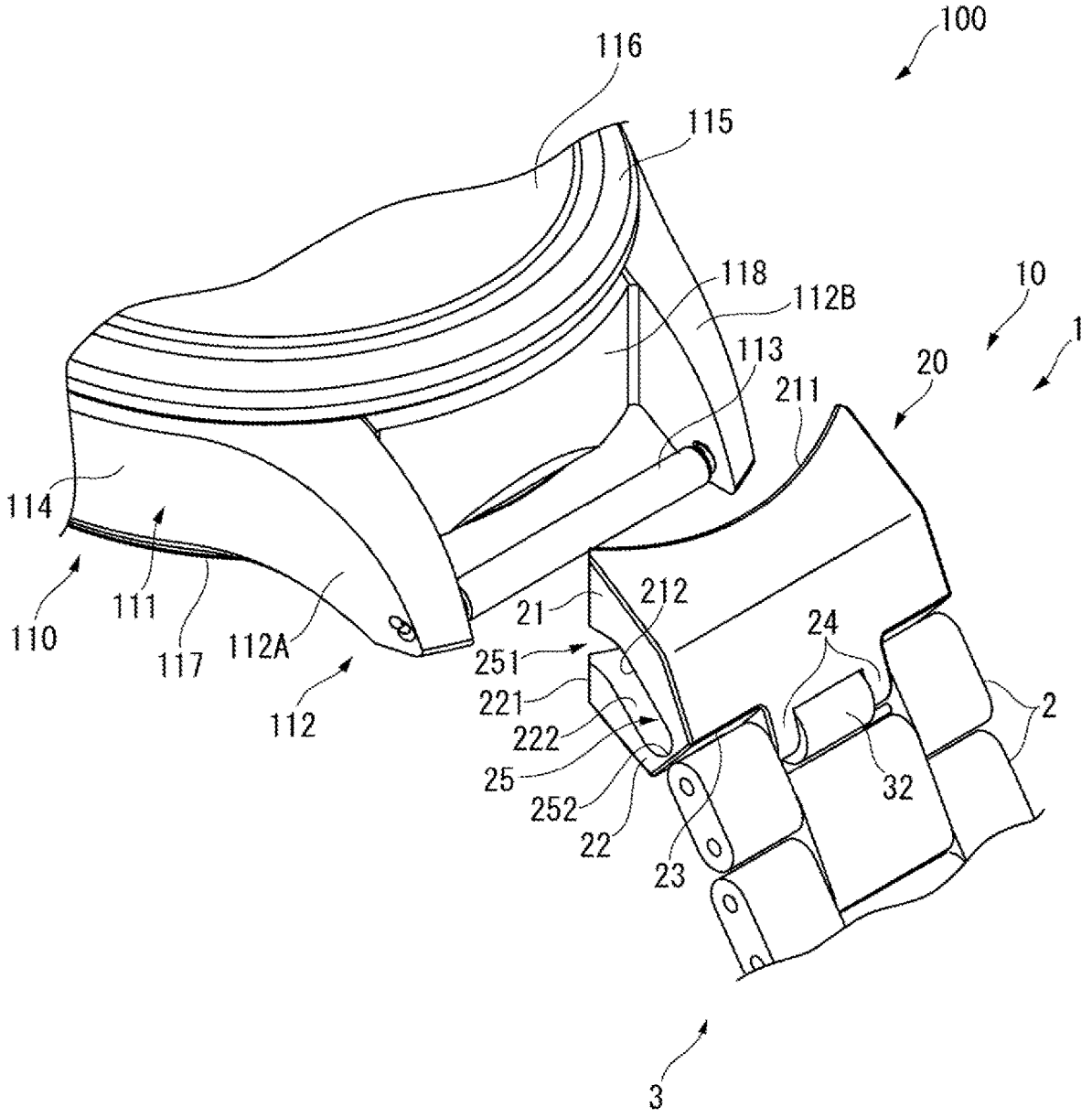
FIG. 1 is a perspective view schematically illustrating a main portion of a watch of the first embodiment.
Figure 2:
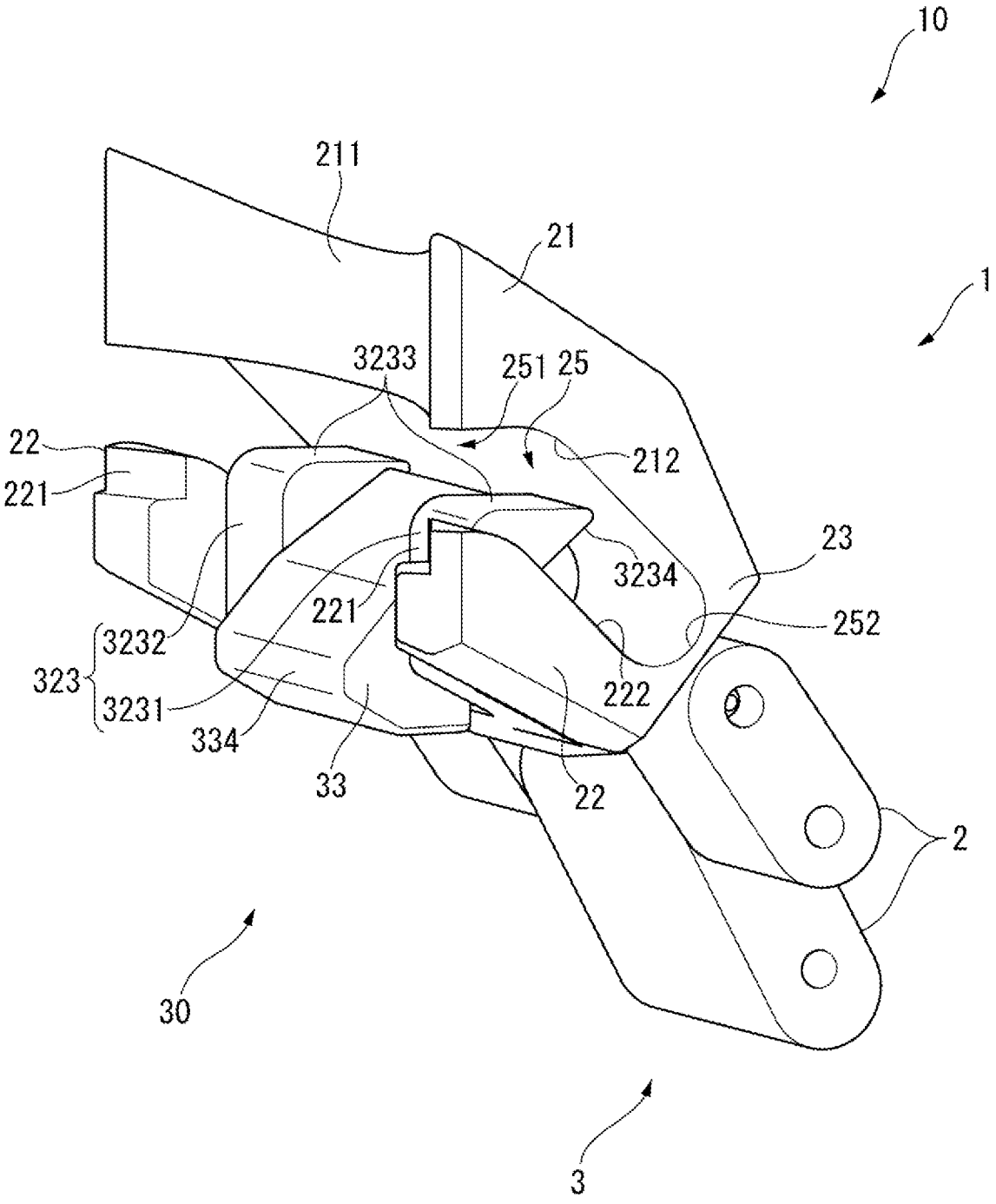
FIG. 2 is a perspective view illustrating a coupler of the first embodiment.
Figure 3:
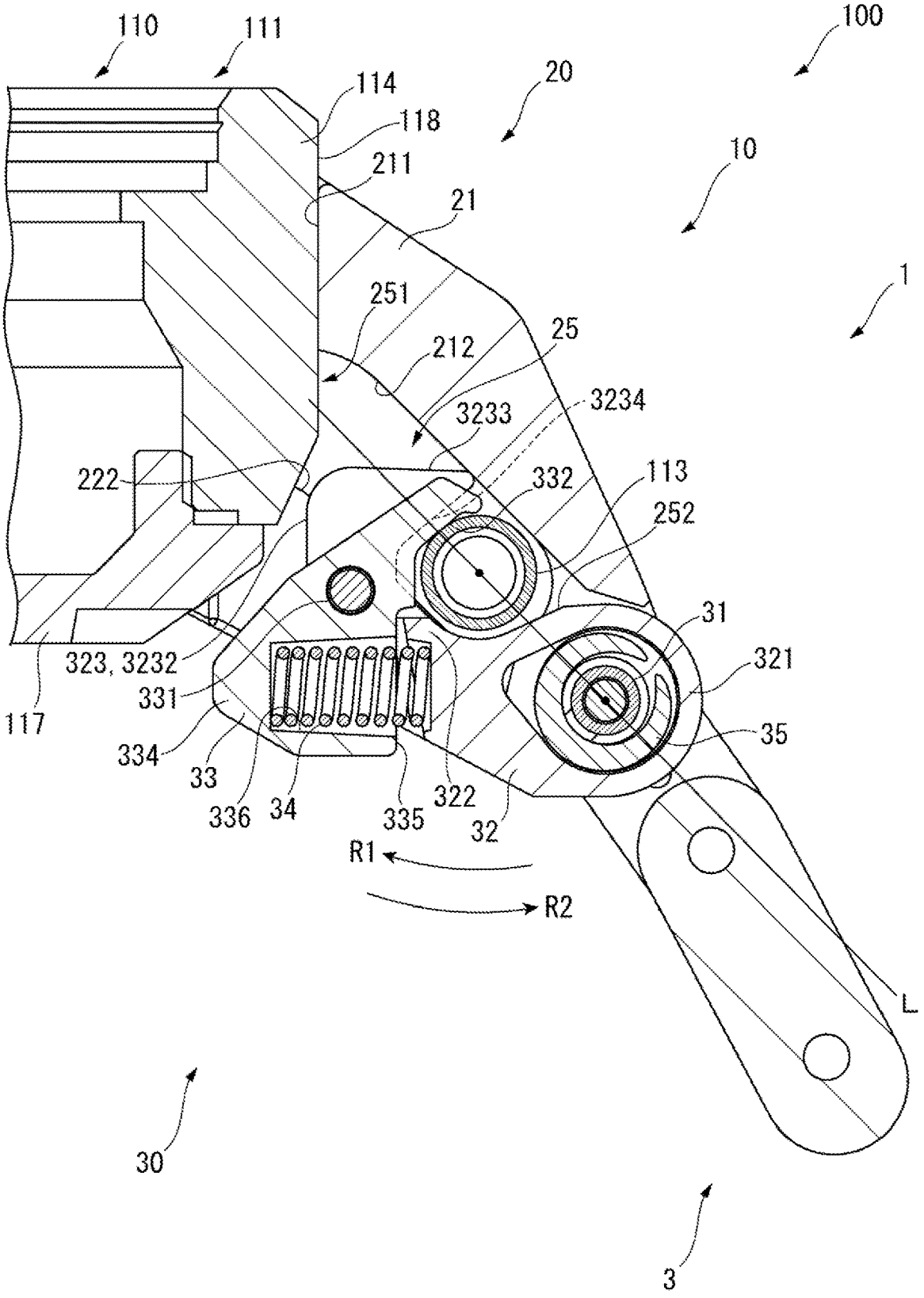
FIG. 3 is a cross-sectional view illustrating a coupler of the first embodiment.
Figure 4:
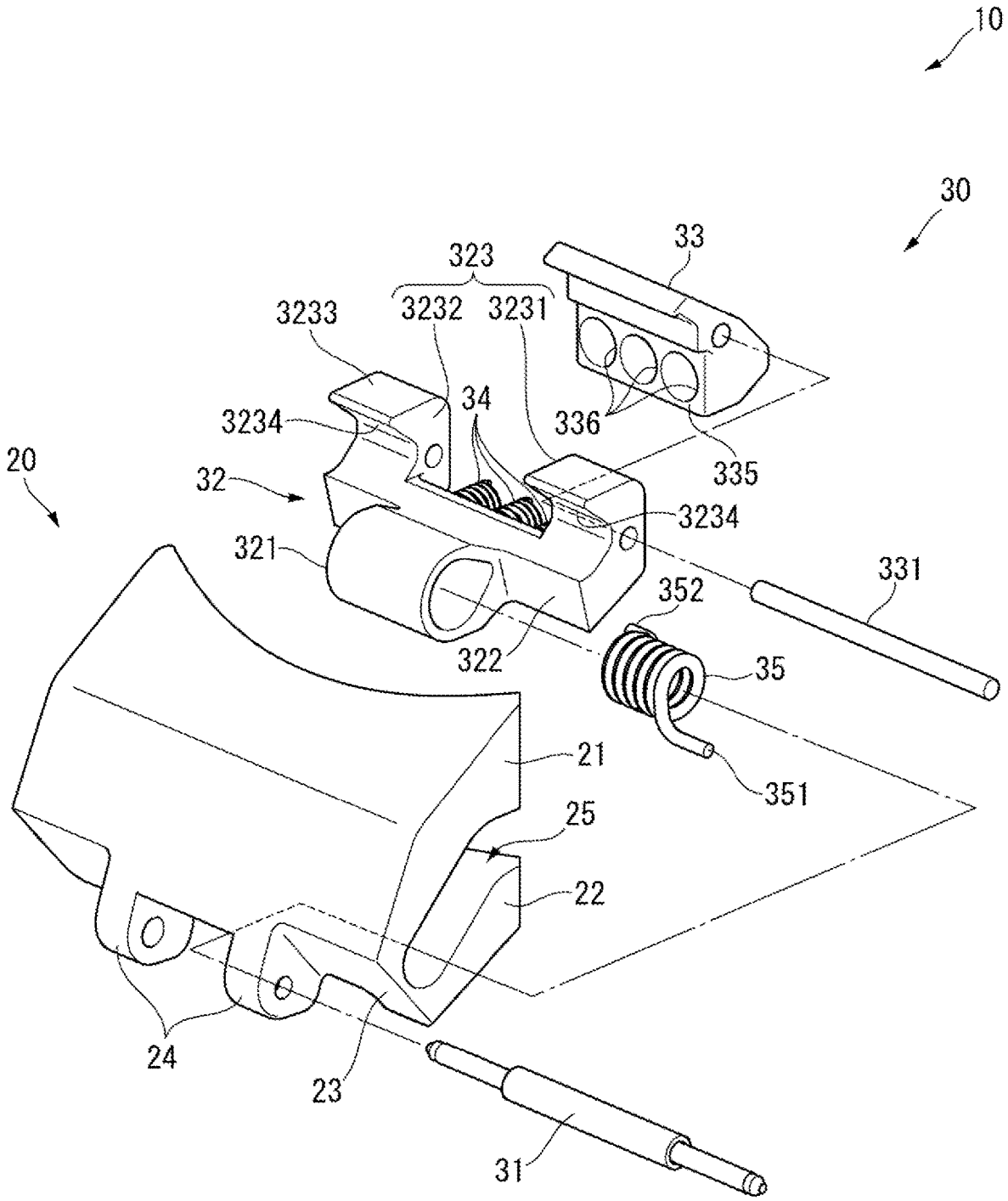
FIG. 4 is an exploded perspective view illustrating a coupler of the first embodiment.
Figure 5:
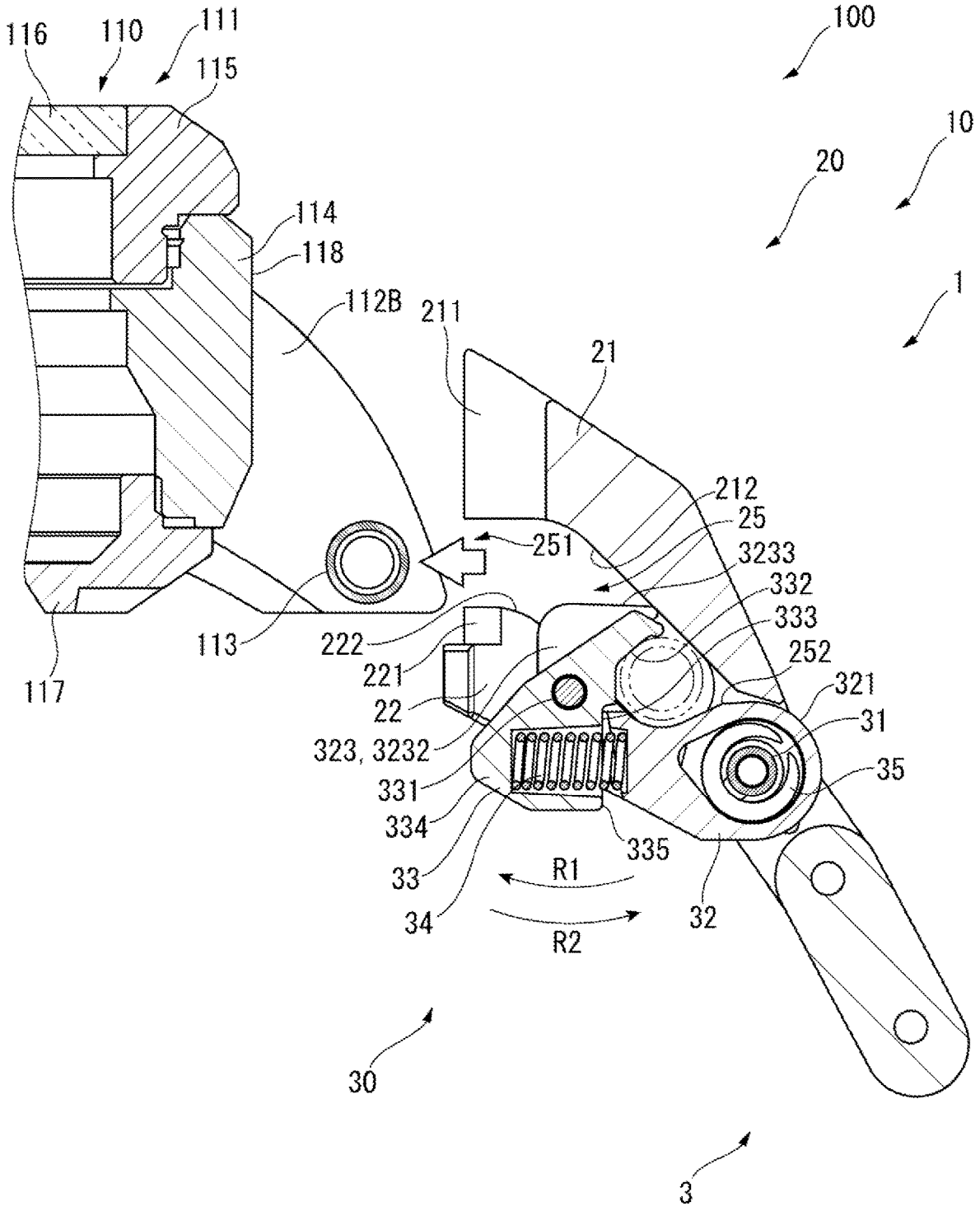
FIG. 5 is a cross-sectional view illustrating a state of attaching a band of the first embodiment to a case.
Figure 6:
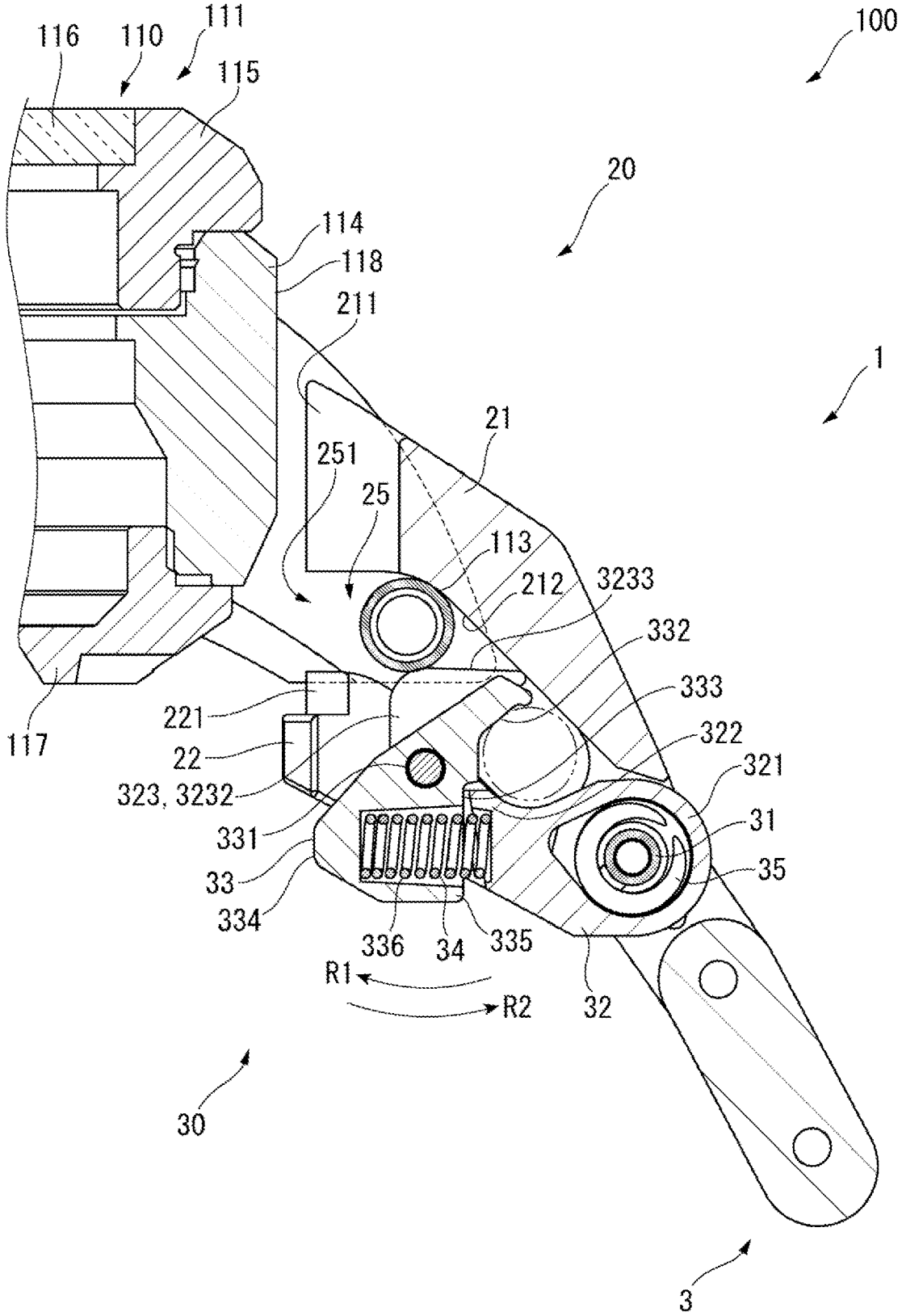
FIG. 6 is a cross-sectional view illustrating a state of attaching a band of the first embodiment to a case.
Figure 7:
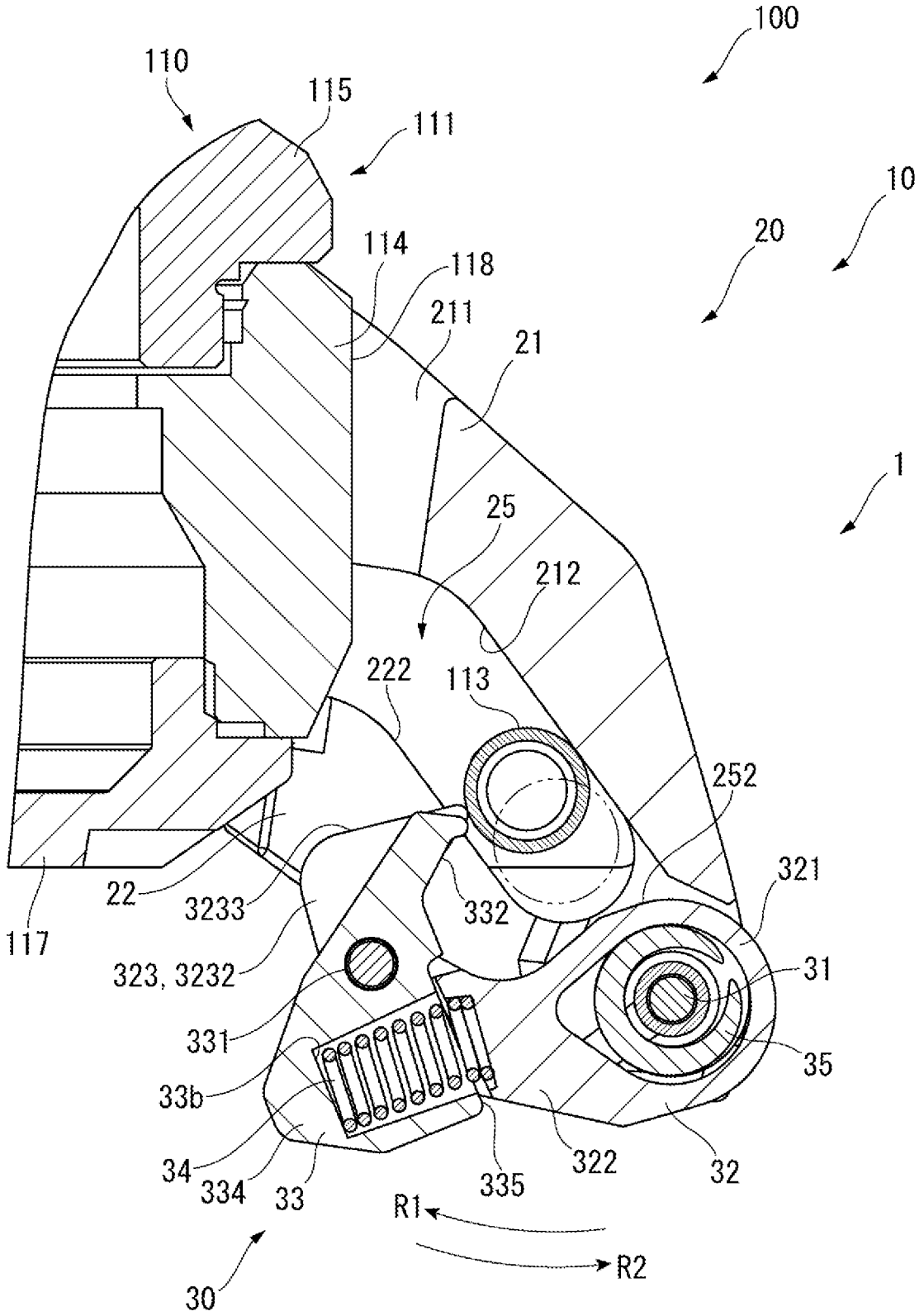
FIG. 7 is a cross-sectional view illustrating a state of attaching a band of the first embodiment to a case.

FIG. 1 is a perspective view schematically illustrating a main portion of the watch 100 according to the first embodiment. FIG. 2 is a perspective view illustrating a coupler 10. FIG. 3 is a cross-sectional view illustrating the coupler 10. FIG. 4 is an exploded perspective view illustrating the coupler 10. Further, FIGS. 5 to 7 are cross-sectional views illustrating a state of attaching a band 1 to a watch body 110.

As illustrated in FIG. 1, the watch 100 includes the watch body 110 and the band 1. Note that the watch body 110 is an example of a wrist-worn device body.

The watch body 110 includes a case 111, a lug 112, and a pin 113.

The case 111 includes a case body 114, a bezel 115, a cover glass 116, and a case back 117.

The case body 114 is a cylindrical member composed of a metal, where inside the cylindrical member, a non-illustrated dial, movement, and the like are arranged. Further, the case body 114 includes a side face 118.

The bezel 115, which is a circular member composed of metal, is disposed on the top of the case body 114. The cover glass 116 is disposed to cover the opening at the upper side of the case body 114. The cover glass 116 is fixed by the bezel 115 to cover the non-illustrated dial. The case back 117, which is a member composed of metal, is disposed to cover the opening at the lower side of the case body 114. Note that in FIG. 3, illustrations of the bezel 115 and the cover glass 116 are omitted.

The lugs 112 are provided in the 6-hour direction and the 12-hour direction of the case body 114. Further, the lugs 112 each include a pair of holding pieces 112A and 112B provided protruding from the side face 118 of the case body 114. Note that the pair of holding pieces 112A and 112B may have identical shapes or different shapes when viewed in a plan view or in a side view. Note that, in the plan view, a shape is viewed from a direction perpendicular to the dial of the watch 100, and in the side view, a shape is viewed from the 3 o'clock direction or the 9 o'clock direction of the watch 100.

The pin 113 is supported by the lug 112, and to which the coupler 10 of the band 1 to be described below is attached. In the first embodiment, the pin 113 is a so-called spring rod. Note that in FIG. 1, the lug 112 and the pin 113 of the watch 100 in the 6-hour direction are solely illustrated.

The band 1 includes a band body 3 constituted by an assembly of a plurality of metal pieces 2, and the couplers 10 coupled to both ends of the band body 3 and attached to the pin 113. Note that in FIG. 1, the coupler 10 to be attached to the pin 113 in the 6-hour direction of the watch 100 is solely illustrated.

Coupler

As illustrated in FIGS. 2 to 4, the coupler 10 is a member for attaching the band 1 to the watch body 110, and includes a coupler body member 20 and a fixing member 30.

The coupler body member 20, which is a member composed of metal, includes a first arm portion 21, a second arm portion 22, an arm portion-coupling portion 23, and a coupler body member-side bearing portion 24. The coupler body member 20 is then provided with a guide groove 25 defined by the first arm portion 21, the second arm portion 22, and the arm portion-coupling portion 23.

The first arm portion 21, which is provided at the upper side in FIG. 2, includes a first contact face 211 and a first partition face 212.

The first contact face 211, which is provided at the tip end side of the first arm portion 21, is in contact with the side face 118 of the case 111. The first contact face 211, which has a curved shape in conformance with the shape of the side face 118 of the case 111, abuts against the side face 118 when the band 1 is attached to the watch body 110.

The first partition face 212, which is a face of the first arm portion 21 at the side of the second arm portion 22, partitions the guide groove 25.

The second arm portion 22 is provided at the opposite side of the first arm portion 21 from the guide groove 25. In the first embodiment, two second arm portions 22 are provided along the axial direction of a first shaft member 31 to be described below, where the fixing member 30 is disposed between the two second arm portions 22.

The second arm portion 22 includes a second contact face 221 and a second partition face 222.

The second contact face 221, which is provided at the tip end side of the second arm portion 22, is in contact with the side face 118 of the case 111. As in the first contact face 211, the second contact face 221, which has a curved shape in conformance with the shape of the side face 118 of the case 111, abuts against the side face 118 when the band 1 is attached to the watch body 110. That is, the side face 118 is an example of the attachment face of the present disclosure, and the first contact face 211 and the second contact face 221 are examples of the contact face of the present disclosure, which are abuttable against the attachment face.

The second partition face 222, which is a face of the second arm portion 22 at the side of the first arm portion 21, partitions the guide groove 25.

The arm portion-coupling portion 23, which is provided at the base end side of the coupler body member 20, couples the first arm portion 21 and the second arm portion 22.

The coupler body member-side bearing portion 24, which is provided at the base end side of the arm portion-coupling portion 23, that is, at the side of the band body 3, into which the first shaft member 31 to be described below is to be inserted.

The guide groove 25 is a groove into which the pin 113 described above is to be inserted.

The guide groove 25, which is defined by the first partition face 212, the second partition face 222, and the arm portion-coupling portion 23 that are described above, is provided with an opening portion 251 and a bottom portion 252.

The opening portion 251 opens to the first contact face 211 and the second contact face 221 at the tip end side of the coupler body member 20. That is, the opening portion 251 is an example of an opening of the present disclosure.

The bottom portion 252 is provided at the end portion of the guide groove 25 at the side of the arm portion-coupling portion 23.

Then, the pin 113, when inserted into the guide groove 25, is inserted through the opening portion 251 to move, along the first partition face 212 and the second partition face 222, to the side of the bottom portion 252.

Further, the guide groove 25 has a shape extending in a horizontal direction from the side of the opening portion 251, and to then bend and extend toward the side of the arm portion-coupling portion 23. This enables to reduce the opening space of the opening portion 251 compared to a case where the guide groove 25 extends obliquely toward the arm portion-coupling portion 23, thus enlarging the surface area of the first contact face 211. Accordingly, rattling of the coupler body member 20 with respect to the case 111 is suppressed.

Fixing Member

The fixing member 30 is a member that fixes the coupler 10 onto the pin 113 described above.

The fixing member 30 is pivotally attached to the coupler body member 20 between the fixing position illustrated in FIG. 3 and the attaching-detaching position illustrated in FIG. 7.

As illustrated in FIG. 3, the fixing member 30, when moved to the fixing position, biases the pin 113 inserted into the guide groove 25 in a direction away from the side face 118 of the case 111 to fix the coupler body member in a state where the first contact face 211 and the second contact face 221 abut against the side face 118 of the case 111.

As illustrated in FIG. 7, the fixing member 30, when moved to the attaching-detaching position, allows insertion of the pin 113 through the opening portion 251 into the guide groove 25 and detachment of the pin 113 inserted through the opening portion 251 into the guide groove 25.

Note that in the first embodiment, the direction in which the fixing member 30 is pivoted from the attaching-detaching position illustrated in FIG. 7 toward the fixing position illustrated in FIG. 3 is referred to as first direction R1, while the direction in which the fixing member 30 is pivoted from the fixing position toward the attaching-detaching position is referred to as second direction R2.

The fixing member 30 includes the first shaft member 31, a base end member 32, a lever member 33, a first elastic member 34, and a second elastic member 35.

The first shaft member 31 is a member that is inserted into the coupler body member-side bearing portion 24 and a base end member-side bearing portion 321 of the base end member 32 to be described below, and pivotally and rotatably supports the base end member 32.

In the first embodiment, the first shaft member 31 is further inserted into the piece 2 located at the end portion of the band body 3 and pivotally couples the coupler body member 20 and the piece 2. That is, in the first embodiment, the pivotal axis of the piece 2 with respect to the coupler body member 20 is the same as the pivotal axis of the fixing member 30.

Further, the first shaft member 31 is attached with the second elastic member 35 that biases the base end member 32 to pivot in the first direction R1 with respect to the coupler body member 20. In the first embodiment, the second elastic member 35 is a so-called torsion coil spring, where a first end portion 351 of the coil is locked to the coupler body member 20 while a second end portion 352 is attached to the base end member 32.

As described above, the base end member 32 is pivotally attached to the coupler body member 20 via the first shaft member 31.

The base end member 32 includes the base end member-side bearing portion 321, a base end member coupling portion 322, and a guide portion 323.

The base end member-side bearing portion 321 is a bearing portion into which the first shaft member 31 is to be inserted. Note that the base end member-side bearing portion 321 is an example of a bearing portion of the present disclosure.

The base end member coupling portion 322, which extends along the axial direction of the first shaft member 31, is a member coupling a first guide portion 3231 and a second guide portion 3232 of the guide portion 323 to be described below.

The guide portion 323 is a member for causing the fixing member 30 to pivot in the second direction R2, when the pin 113 is inserted into the guide groove 25, to guide the pin 113 along the first partition face 212 and the second partition face 222. In the state illustrated in FIG. 5, the guide portion 323 is biased toward the second elastic member 35 to come in contact with the first partition face 212 of the first arm portion 21.

The guide portion 323 includes the first guide portion 3231 and the second guide portion 3232 provided at the first end side and the second end side of the base end member coupling portion 322, and extending in a direction orthogonal to the axial direction of the first shaft member 31.

As illustrated in FIGS. 3 to 7, the first guide portion 3231 and the second guide portion 3232 each include an abutting face 3233 and a restricting face 3234.

The abutting face 3233 is a face that abuts against the pin 113 inserted into the guide groove 25. Further, the abutting face 3233 is inclined with respect to the first partition face 212 and the second partition face 222 such that the base end member 32 pivots in the second direction R2 toward the attaching-detaching position illustrated in FIG. 7 when the pin 113 is further inserted from the state illustrated in FIG. 6, along the first partition face 212 and the second partition face 222, toward the bottom portion 252 of the guide groove 25. That is, the abutting face 3233 is inclined with respect to the insertion direction of the pin 113.

The restricting face 3234 is a face at the side of the arm portion-coupling portion 23 in the first guide portion 3231 and the second guide portion 3232.

As illustrated in FIG. 3, the restricting face 3234 is substantially orthogonal to a straight line L passing through the center of the pin 113 and the first shaft member 31 with the pin 113 being inserted into the guide groove 25. Thus, even if a stress is applied to the restricting face 3234 via the pin 113 when the coupler 10 is pulled away from the watch body 110 via the band body 3, the stress is applied in a direction away from the watch body 110 along the straight line L. Accordingly, the moment of causing the first guide portion 3231 and the second guide portion 3232 to pivot in the second direction R2 hardly occurs due to the stress. Thus, even if the band body 3 is unintentionally pulled, the pin 113 can be prevented from being detached from the guide groove 25 due to the first guide portion 3231 and the second guide portion 3232 pivoting in the second direction R2.

The lever member 33 is a member that is biased by the first elastic member 34 to bias the pin 113 inserted into the guide groove 25.

The lever member 33 includes a second shaft member 331, a biasing contact face 332, a stopper portion 333, an operation portion 334, and an engagement portion 335, and is provided with a receiving recessed portion 336.

The second shaft member 331, which is inserted into the first guide portion 3231, the second guide portion 3232, and the lever member 33, pivotally supports the lever member 33. This allows the lever member 33 to be disposed between the first guide portion 3231 and the second guide portion 3232.

The biasing contact face 332 is a face that comes in contact with the pin 113 inserted into the guide groove 25 to bias the pin 113.

As illustrated in FIG. 5, the stopper portion 333 is in contact with the base end member coupling portion 322 in a state where the pin 113 is not inserted into the guide groove 25. This prevents, in a state where the pin 113 is not inserted, the lever member 33 from pivoting excessively in the first direction R1.

The operation portion 334 is a section that the wearer operates when causing the fixing member 30 to pivot. The wearer depresses the operation portion 334 to enable the fixing member 30 to pivot in the second direction R2.

The engagement portion 335, when the lever member 33 is depressed, engages with the base end member coupling portion 322. Accordingly, the lever member 33 engages with the base end member 32 when the wearer operates the operation portion 334 to depress the lever member 33, thus, the base end member 32 pivots, along with the lever member 33, in the second direction R2.

The first elastic member 34 is a member that is received in the receiving recessed portion 336 of the lever member 33 to bias the lever member 33 to pivot in the first direction R1. In the first embodiment, the first elastic member 34 is a so-called helical compression spring, where the first end side is in contact with the bottom portion of the recessed portion provided at the base end member 32, and the other end side is in contact with the bottom portion of the receiving recessed portion 336. In addition, in the first embodiment, three units of the first elastic member 34 are arranged along the axial direction of the second shaft member 331.

Method of Attaching and Detaching Band

Next, method of attaching and detaching the band 1 will be described below.

First, as illustrated in FIG. 5, in a state where the pin 113 is not inserted into the guide groove 25, that is, in a state where the band 1 is not attached to the watch body 110, the coupler 10 is moved closer from the side of the case 111. The pin 113 is then inserted through the opening portion 251 along the first partition face 212 toward the bottom portion 252.

Then, as illustrated in FIG. 6, the pin 113 comes in contact with the abutting face 3233. Here, in the first embodiment, the abutting face 3233 is inclined with respect to the insertion direction of the pin 113 such that the base end member 32 pivots in the second direction R2. Thus, in this state, when the pin Thus, in this state, the pin 113, when further inserted along the first partition face 212, causes the guide portion 323 and the base end member 32 to pivot toward the second direction R2. The engagement portion 335 of the lever member 33 then engages with the base end member coupling portion 322 of the base end member 32 to cause the lever member 33 to pivot in the second direction R2 as well. This allows the fixing member 30 to move to the attaching-detaching position, as illustrated in FIG. 7. That is, in the first embodiment, the attaching-detaching position is a position at which the fixing member 30 is depressed not to overlap with the guide groove 25 when viewed as a cross-section from the axial direction of the first shaft member 31.

The pin 113, when further inserted from the state illustrated in FIG. 7, along the first partition face 212, toward the bottom portion 252, releases the contact state between the abutting face 3233 and the pin 113. This allows the elastic forces of the first elastic member 34 and the second elastic member 35 to bias the base end member 32 and the lever member 33 to pivot in the first direction R1, and then the fixing member 30 moves to the fixing position, as illustrated in FIG. 3. That is, in the first embodiment, the fixing position is a position at which the fixing member 30 is disposed between the pin 113 and the case 111 when viewed as a cross-section from the axial direction of the first shaft member 31.

Further, in the fixing member 30 having been moved to the fixing position, the lever member 33 is biased by the first elastic member 34 to bias the pin 113 away from the case 111.

Then, a counteraction of the above action biases the coupler body member 20 in the direction closer to the case 111 via the fixing member 30. This allows the first contact face 211 and the second contact face 221 of the coupler body member 20 to be pressed against the side face 118 of the case 111, to thus fix the coupler 10 onto the case 111, and then attach the band 1 to the watch body 110.

On the other hand, when detaching the band 1 from the watch body 110, the wearer, from the state illustrated in FIG. 3, operates the operation portion 334 to cause the lever member 33 to pivot in the second direction R2, and to move the fixing member 30 to the attaching-detaching position illustrated in FIG. 7. This allows the pin 113 to move along the first partition face 212, and allows the pin 113 to be pulled out through the opening portion 251.

Advantageous Functions and Effects of First Embodiment

According to the first embodiment thus described, the following advantageous effects can be provided.

In the first embodiment, the coupler 10 includes the coupler body member 20 and the fixing member 30.

The coupler body member 20 is provided with the first contact face 211 and the second contact face 221 that are abuttable against the side face 118 of the case 111 and the guide groove 25 into which the pin 113 is insertable, and is coupled to the end portion of the watch body 110.

The fixing member 30 is attached to the coupler body member to be movable 20 between the fixing position and the attaching-detaching position. The fixing position is a position at which the fixing member 30 biases the pin 113 inserted into the guide groove 25 away from the side face 118 of the case 111 to fix the coupler body member 20. Further, the attaching-detaching position is a position at which insertion of the pin 113 through the opening portion 251 into the guide groove 25 and detachment of the pin 113 inserted into the guide groove 25 are allowed.

This allows, by moving the fixing member 30 to the fixing position and the attaching-detaching position, the band 1 to be attached to and detached from the watch body 110.

Further, the fixing member 30 avoids contact with the case 111 when the fixing member 30 pivots between the attaching-detaching position and the fixing position. Thus, in the first embodiment, when attaching and detaching the band 1 to/from the watch body 110, the fixing member 30 being a movable portion avoids contact with the case 111, to thus prevent the case 111 from being scraped against the fixing member 30 and scratches from being generated.

In the first embodiment, the fixing member 30 includes the base end member 32 pivotally attached to the coupler body member 20, and the lever member 33 pivotally attached to the base end member 32 to bias the pin 113. Then, the base end member 32 and the lever member 33 are biased due to the elastic forces of the first elastic member 34 and the second elastic member 35. Thus, the pin 113 inserted into the guide groove 25 can be biased in the first direction R1 with a simple structure.

Further, in the first embodiment, the lever member 33 is biased by the first elastic member 34, and the base end member 32 is biased by the second elastic member 35. This allows the biasing force that biases the base end member 32 and the biasing force that biases the lever member 33 to be set at any level. This enables facilitating the biasing force required to fix the coupler body member 20 onto the side face 118 of the case 111.

In the first embodiment, the guide portion 323, in a state where the pin 113 is not loaded at the guide groove 25, comes in contact with the first partition face 212 of the guide groove 25. That is, the guide portion 323 functions as a stopper for the base end member 32. This prevents the base end member 32 from pivoting excessively in the first direction R1 by being biased by the second elastic member 35.

In the first embodiment, the abutting face 3233 of the guide portion 323, while abutting against the pin 113 and further when the pin 113 is inserted into the guide groove 25, is inclined with respect to the insertion direction of the pin 113 such that the base end member 32 pivots in the second direction R2. Accordingly, even if the wearer does not depress the lever member 33 to cause the pin 113 to be inserted into the guide groove 25, the fixing member 30 pivoting in the second direction R2 allows the pin 113 to be easily inserted into the guide groove 25. This facilitates the attachment operation of the band 1.

In the first embodiment, the band 1 is caused to be attached to the watch body 110 in such a way that the coupler 10 is moved closer from the side of the case 111, and the pin 113 is inserted through the opening portion 251 along the first partition face 212 toward the bottom portion 252.

Here, supposing that, for example, the case 111 is provided, in a plan view, with the bezel 115 or a bezel that partially protrude from the side face 118 of the case 111, the portions of the bezel 115 or the bezel, which protrude from the side face 118, become an obstacle to prevent a coupler of a type of being attached by being moved closer from the upper side of the case 111 from being attached to the band 1 and the watch body 110.

In contrast, in the first embodiment, the coupler 10 is moved closer from the side of the case 111, the bezel 115 or the bezel, even if protruding from the side face 118, does not become an obstacle, to thus facilitate the attachment operation of the band 1.

Second Embodiment

Next, a watch 100A according to the second embodiment of the present disclosure will be described below with reference to FIGS. 8 to 10.

A band 1A of the second embodiment differs from the first embodiment in that a base end member is not provided at a fixing member 30A and a lever member 33A is directly attached to a coupler body member 20A. Note that components of the second embodiment that are identical or similar to the corresponding components of the first embodiment are denoted by identical reference signs and that descriptions of these components are omitted.

Coupler

Figure 8:
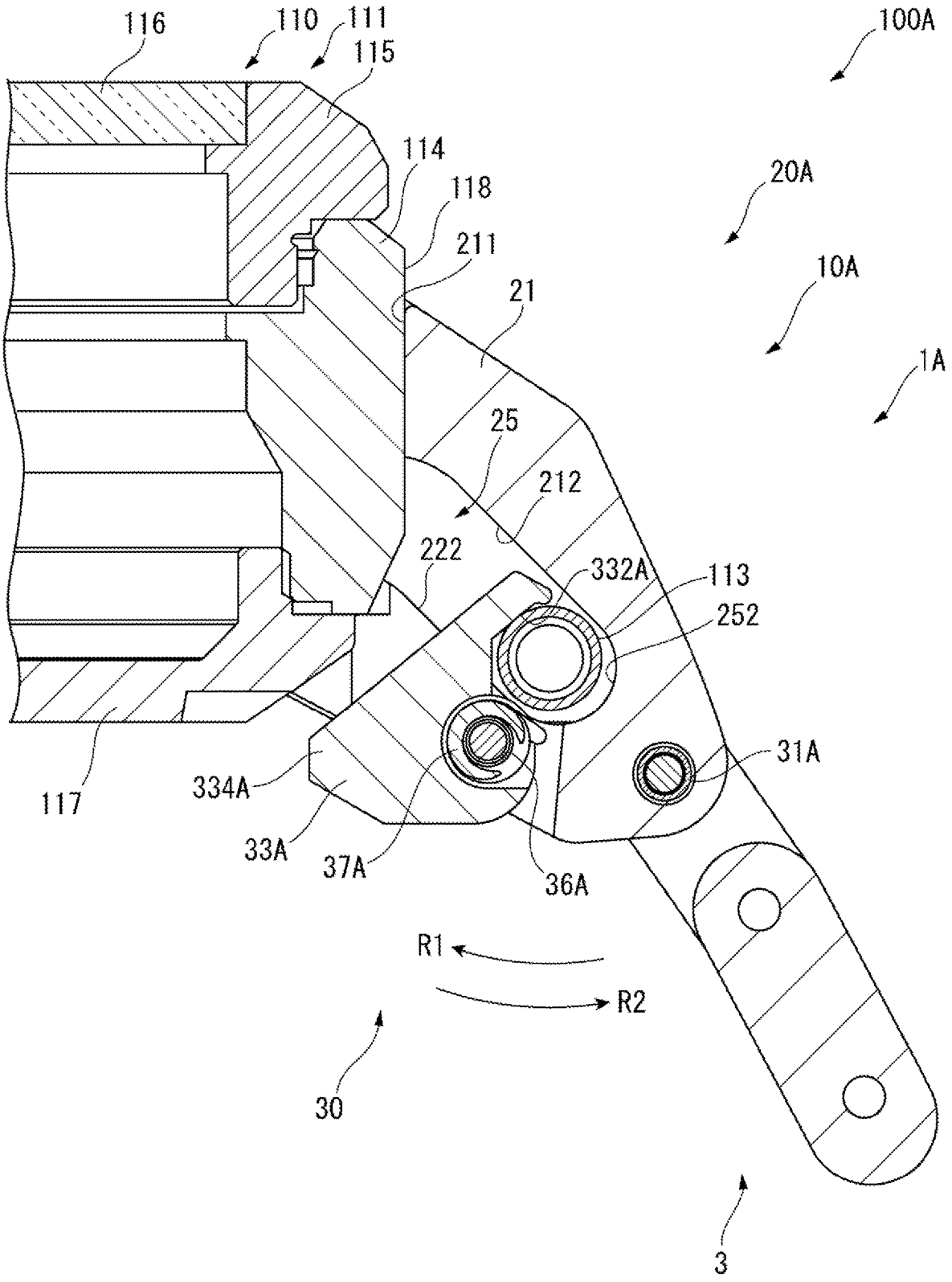
FIG. 8 is a cross-sectional view illustrating a coupler of the second embodiment.
Figure 9:
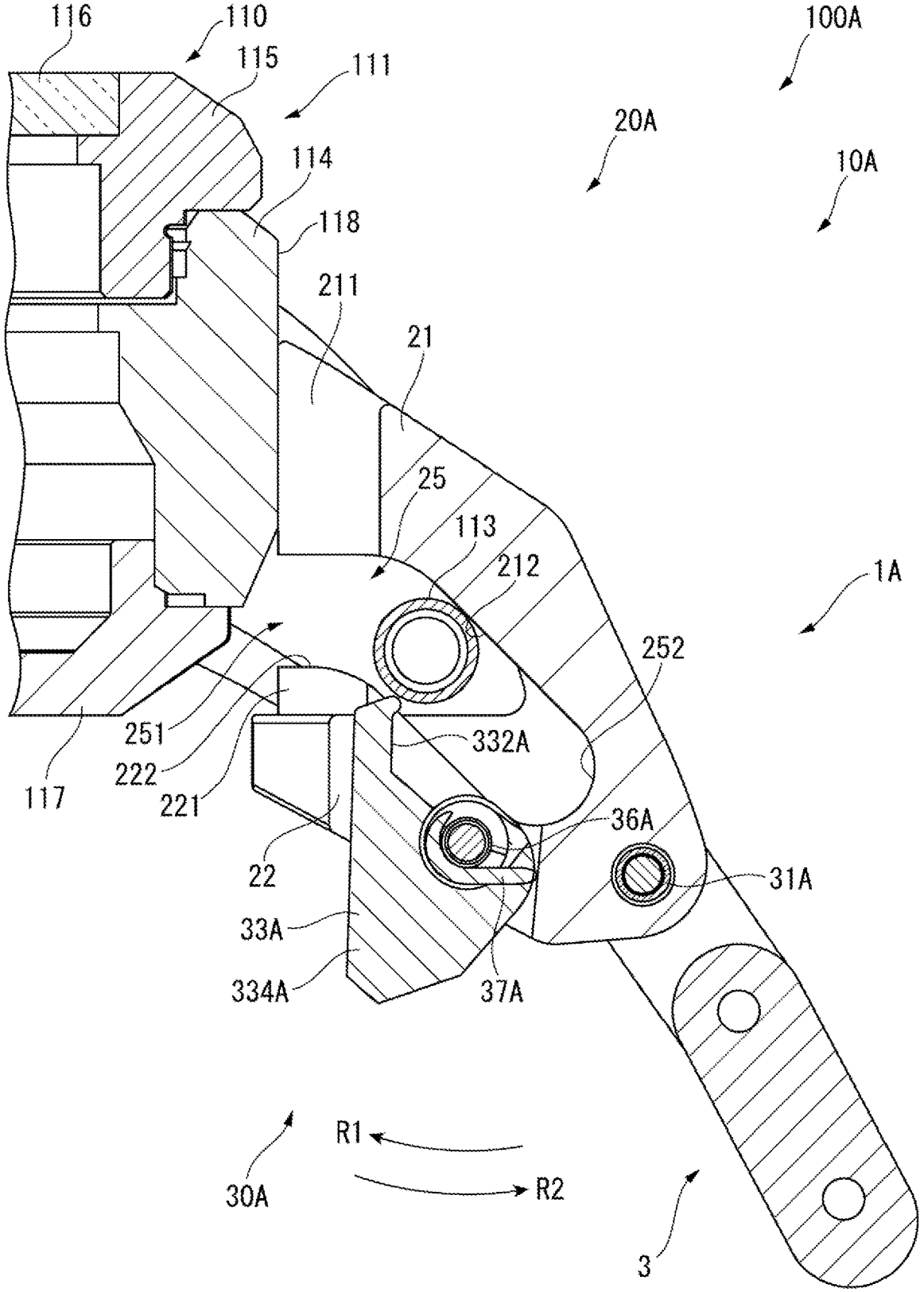
FIG. 9 is a cross-sectional view illustrating a state of attaching a band of the second embodiment to a case.
Figure 10:
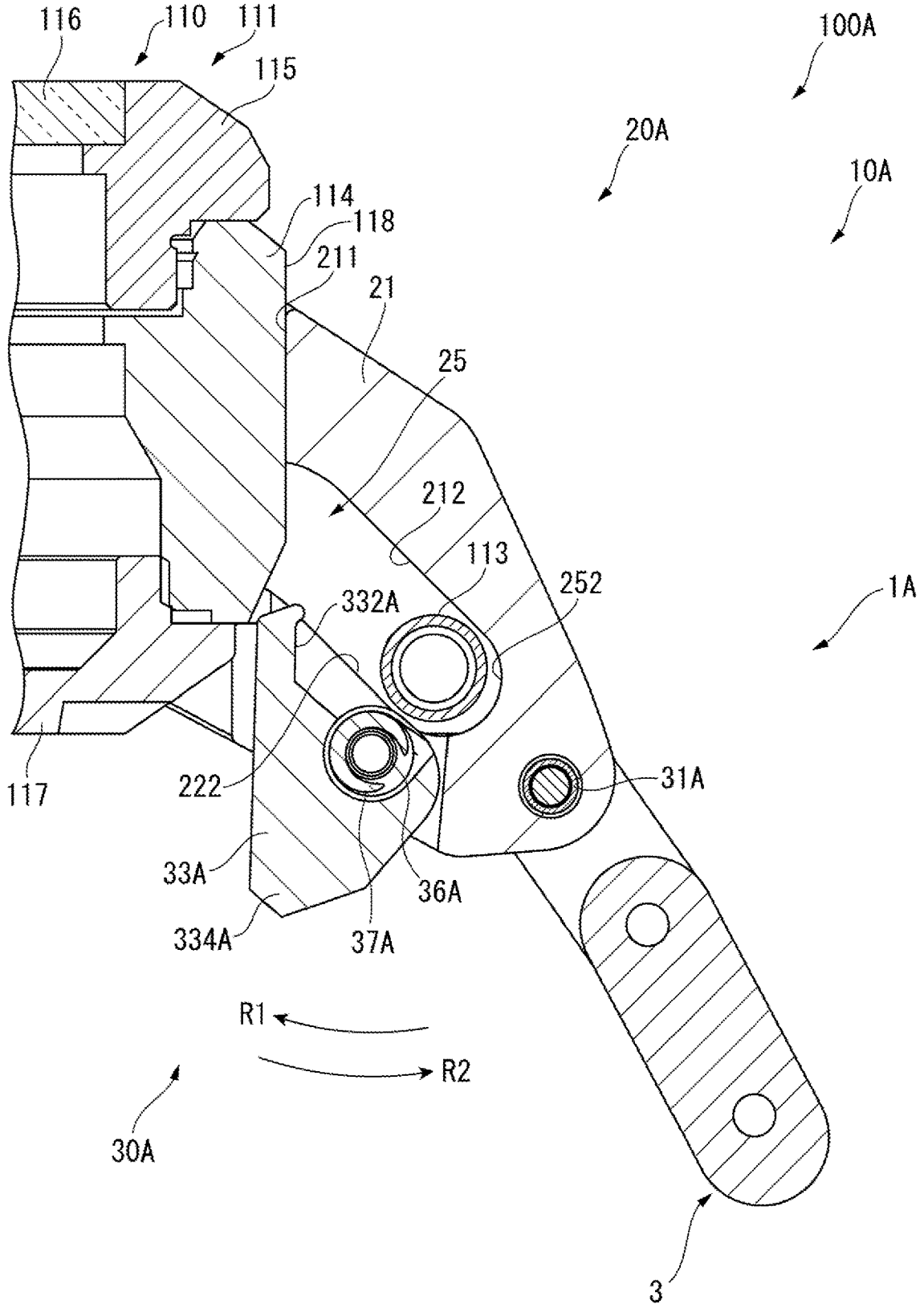
FIG. 10 is a cross-sectional view illustrating a state of attaching a band of the second embodiment to a case.

FIG. 8 is a cross-sectional view illustrating a coupler 10A according to the second embodiment, and FIGS. 9 and 10 are cross-sectional views illustrating a state of attaching the band 1A to the watch body 110.

As illustrated in FIGS. 8 to 10, the coupler 10A includes the coupler body member 20A and the fixing member 30A.

Fixing Member

The fixing member 30A, which includes the lever member 33A, includes a first shaft member 31A, a third shaft member 36A, and a third elastic member 37A. In the second embodiment, unlike the first embodiment described above, the lever member 33A is directly pivotally attachable to the coupler body member 20A via the third shaft member 36A. Further, the coupler body member 20A is coupled to the piece 2 located at the end portion of the band 1A via the first shaft member 31A. That is, in the second embodiment, the pivotal axis of the piece 2 with respect to the coupler body member 20A differs from the pivotal axis of the fixing member 30A.

Further, the third shaft member 36A is attached with the third elastic member 37A that biases the lever member 33A in the first direction R1. In the second embodiment, the third elastic member 37A is a so-called torsion coil spring, and one end portion of the coil is attached to the coupler body member 20A while the other end portion is attached to the lever member 33A.

Method of Attaching and Detaching Band

Next, a method of attaching and detaching the band 1A of the second embodiment will be described below.

First, as illustrated in FIG. 9, the wearer operates an operation portion 334A to depress the lever member 33A. That is, the wearer causes the fixing member 30A to pivot in the second direction R2 to move to the attaching-detaching position. Then, the pin 113 is inserted through the opening portion 251 of the guide groove 25 to move, along the first partition face 212, toward the bottom portion 252, as illustrated in FIG. 10.

Subsequently, when the force having depressed the lever member 33A is released, the lever member 33A is biased by the third elastic member 37A to pivot toward the first direction R1 and to then move to the fixing position, as illustrated in FIG. 8. In the state illustrated in FIG. 8, the lever member 33A is then biased due to the elastic force of the third elastic member 37A to cause a biasing contact face 332A to bias the pin 113 away from the case 111.

Then, as in the first embodiment described above, the first contact face 211 and the second contact face 221 of the coupler body member 20A are pressed against the side face 118 of the case 111 to fix the coupler 10A onto the case 111, and to then attach the band 1A to the watch body 110.

On the other hand, when detaching the band 1A from the watch body 110, as in the first embodiment described above, the wearer, from the state illustrated in FIG. 8, operates the operation portion 334A to cause the lever member 33A to pivot in the second direction R2 to pull out the pin 113 through the opening portion 251.

Advantageous Functions and Effects of Second Embodiment

According to the second embodiment thus described, the following advantageous effects can be provided.

In the second embodiment, the fixing member 30A includes the lever member 33A to be pivotally attached to the coupler body member 20A. That is, the lever member 33A, which is directly attached to the coupler body member 20A, makes components such as the base end member 32 of the first embodiment needless. This makes it possible to reduce the number of components to improve the workability while assembling is performed.

Third Embodiment

Next, the third embodiment of the present disclosure is described below with reference to FIG. 11.

A band 1B of the third embodiment differs from the first and second embodiments described above in that a lever member 33B is made elastically deformable. Note that components of the third embodiment that are identical or similar to the corresponding components of the first and second embodiments are denoted by identical reference signs and that descriptions of these components are omitted.

Coupler

Figure 11:
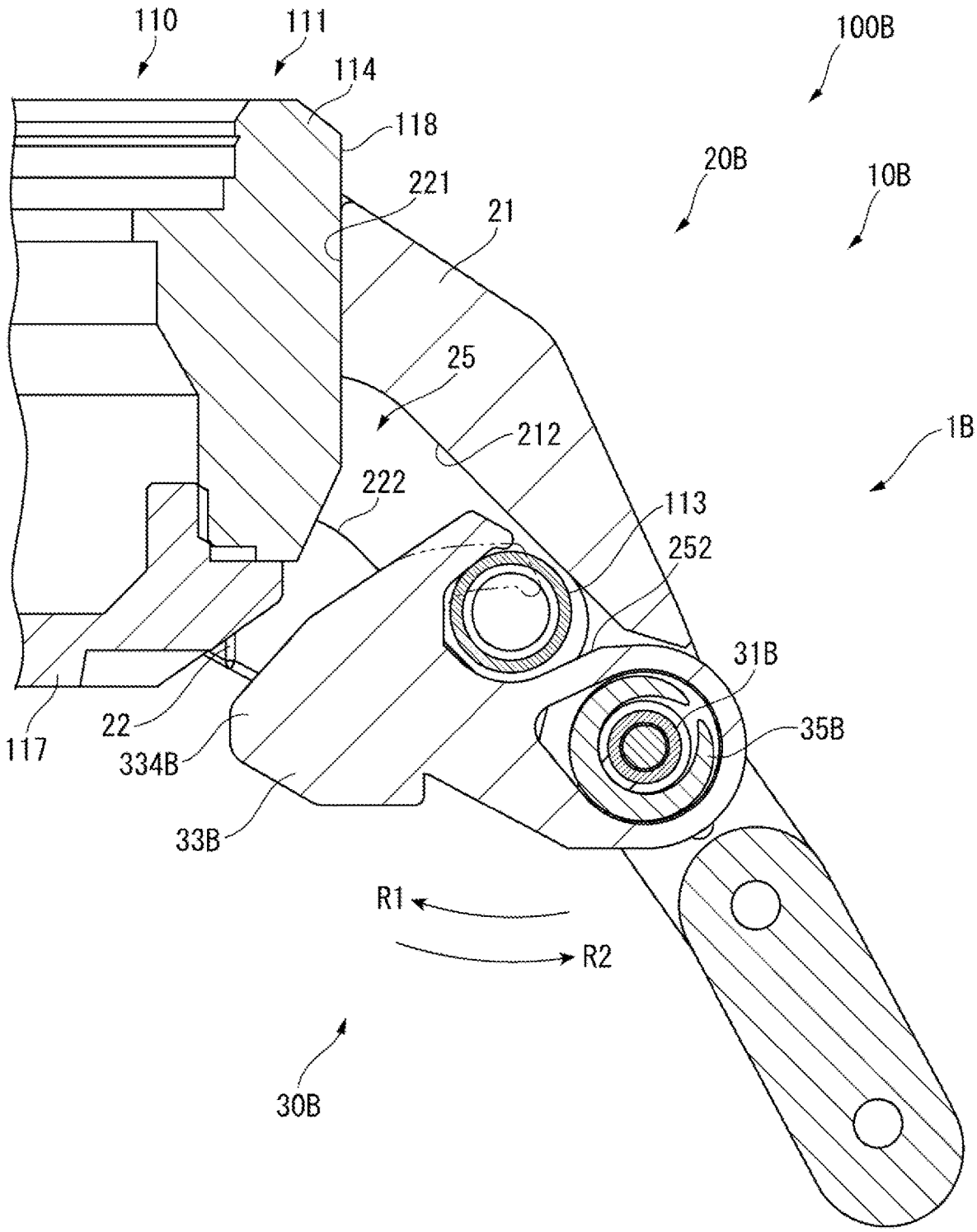
FIG. 11 is a cross-sectional view illustrating a coupler of the third embodiment.

FIG. 11 is a cross-sectional view schematically illustrating a coupler 10B according to the third embodiment. Note that in FIG. 11, illustrations of the bezel 115 and the cover glass 116 are omitted.

As illustrated in FIG. 11, the coupler 10B includes a coupler body member 20B and a fixing member 30B.

Fixing Member

The fixing member 30B, which includes the lever member 33B composed of an elastic member, includes a first shaft member 31B and a second elastic member 35B. In the third embodiment, the lever member 33B is directly pivotally attached to the coupler body member 20B via the first shaft member 31B to be operable by an operation portion 334B. The first shaft member 31B is attached with the second elastic member 35B that biases the lever member 33B in the first direction R1.

Further, as illustrated in FIG. 11, the lever member 33B, while biasing the pin 113 inserted into the guide groove 25, is elastically deformed from a state indicated by two-dot chain line to a state indicated by solid line. That is, in the third embodiment, the lever member 33B biases the pin 113 with the elastic forces of the second elastic member 35B and the lever member 33B.

Advantageous Functions and Effects of Third Embodiment

According to the third embodiment thus described, the following advantageous effects can be provided.

In the third embodiment, the fixing member 30B includes the lever member 33B that is directly pivotally attached to the coupler body member 20B. This makes it possible to reduce the number of components to improve the workability while assembling is performed, as in the second embodiment.

Further, the lever member 33B, which is made elastically deformable, biases the pin 113 with the elastic forces of the second elastic member 35B and the lever member 33B. This allows the biasing force from the second elastic member 35 and the biasing force from the lever member 33B to be set at any level, thus facilitating setting of the biasing force required to fix the coupler body member 20B onto the side face 118 of the case 111.

Fourth Embodiment

Next, a watch 100C according to the fourth embodiment of the present disclosure is described below with reference to FIG. 12.

The watch 100C of the fourth embodiment differs from the first to third embodiments described above in that the watch body 110 is provided with an elastic pin 119C being elastically deformable, where a fixing member 30C is biased by the elastic pin 119C when attaching a coupler 10C to the watch body 110. Note that components of the fourth embodiment that are identical or similar to the corresponding components of the first and second embodiments are denoted by identical reference signs and that descriptions of these components are omitted.

Figure 12:
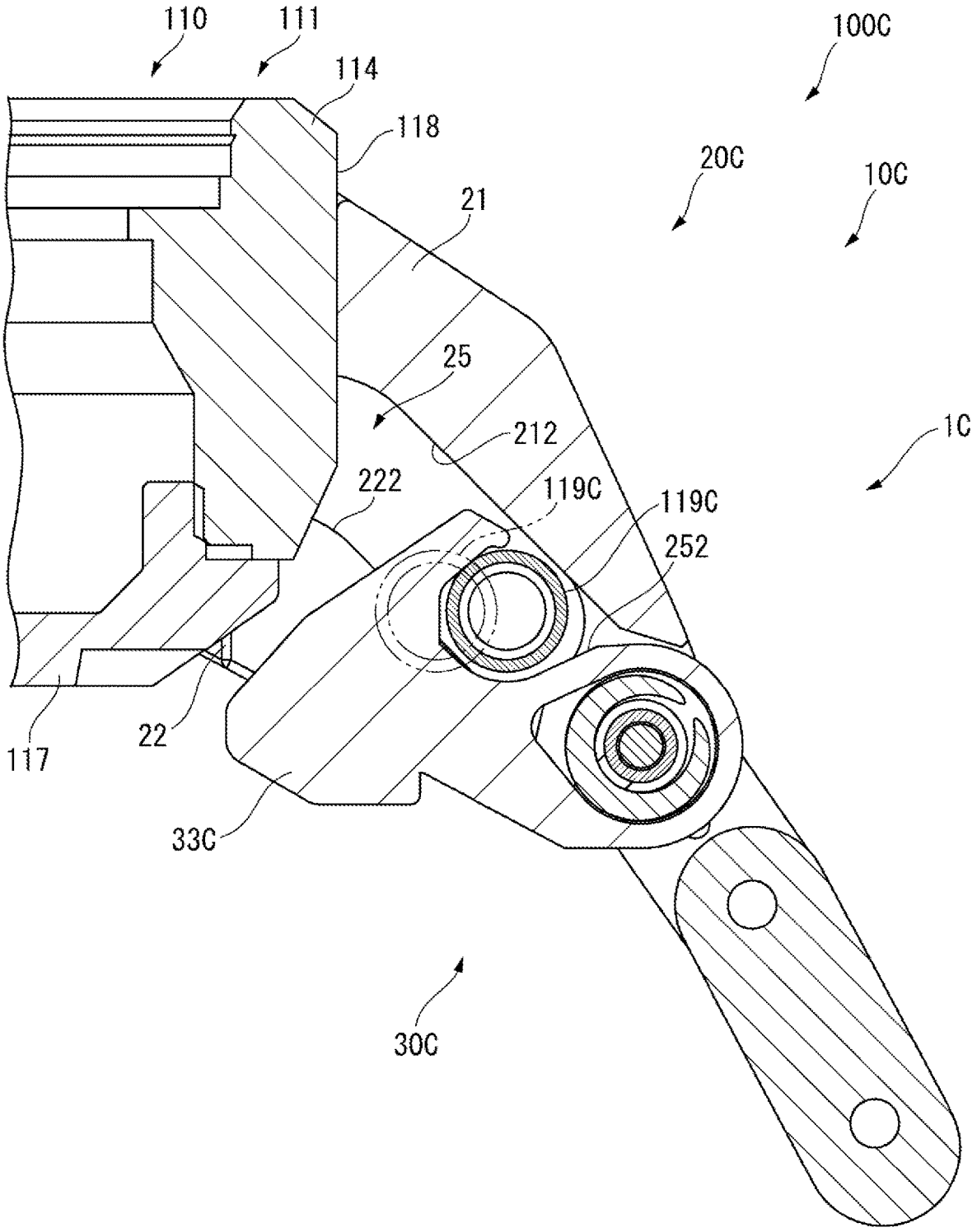
FIG. 12 is a cross-sectional view illustrating a coupler and an elastic pin of the fourth embodiment.

FIG. 12 is a cross-sectional view schematically illustrating the coupler 10C and the elastic pin 119C according to the fourth embodiment. Note that in FIG. 12, illustrations of the bezel 115 and the cover glass 116 are omitted.

As illustrated in FIG. 12, in the watch 100C, the watch body 110 is provided with the elastic pin 119C that is elastically deformable.

Further, the elastic pin 119C, while being inserted into the guide groove 25 and fixed by the fixing member 30C, is elastically deformed from a state indicated by two-dot chain line to a state indicated by solid line. That is, the elastic pin 119C is made elastically deformable in the direction intersecting the axial direction. This allows the elastic pin 119C to bias a lever member 33C to the side of the case 111. Accordingly, the first contact face 211 and the second contact face 221 of a coupler body member 20C are pressed against the side face 118 of the case 111 to fix the coupler 10C onto the case 111, and to then attach a band 1C to the watch body 110.

Advantageous Functions and Effects of Fourth Embodiment

According to the fourth embodiment thus described, the following advantageous effects can be provided.

In the fourth embodiment, the watch body 110 is provided with the elastic pin 119C being elastically deformable, where the elastic pin 119C biases the fixing member 30C to attach the band 1C to the watch body 110. Accordingly, in the coupler 10C, components that biases the elastic pin 119C can be made needless, thus making it possible to reduce the number of components to improve the workability while assembling is performed.

Fifth Embodiment

Next, the fifth embodiment of the present disclosure will be described below with reference to FIG. 13.

A band 1D of the fifth embodiment differs from the first to fourth embodiments described above in that a surface member 4D is attached to the surface of a coupler body member 20D. Note that components of the fifth embodiment that are identical or similar to the corresponding components of the first to fourth embodiments are denoted by identical reference signs and that descriptions of these components are omitted.

Figure 13:
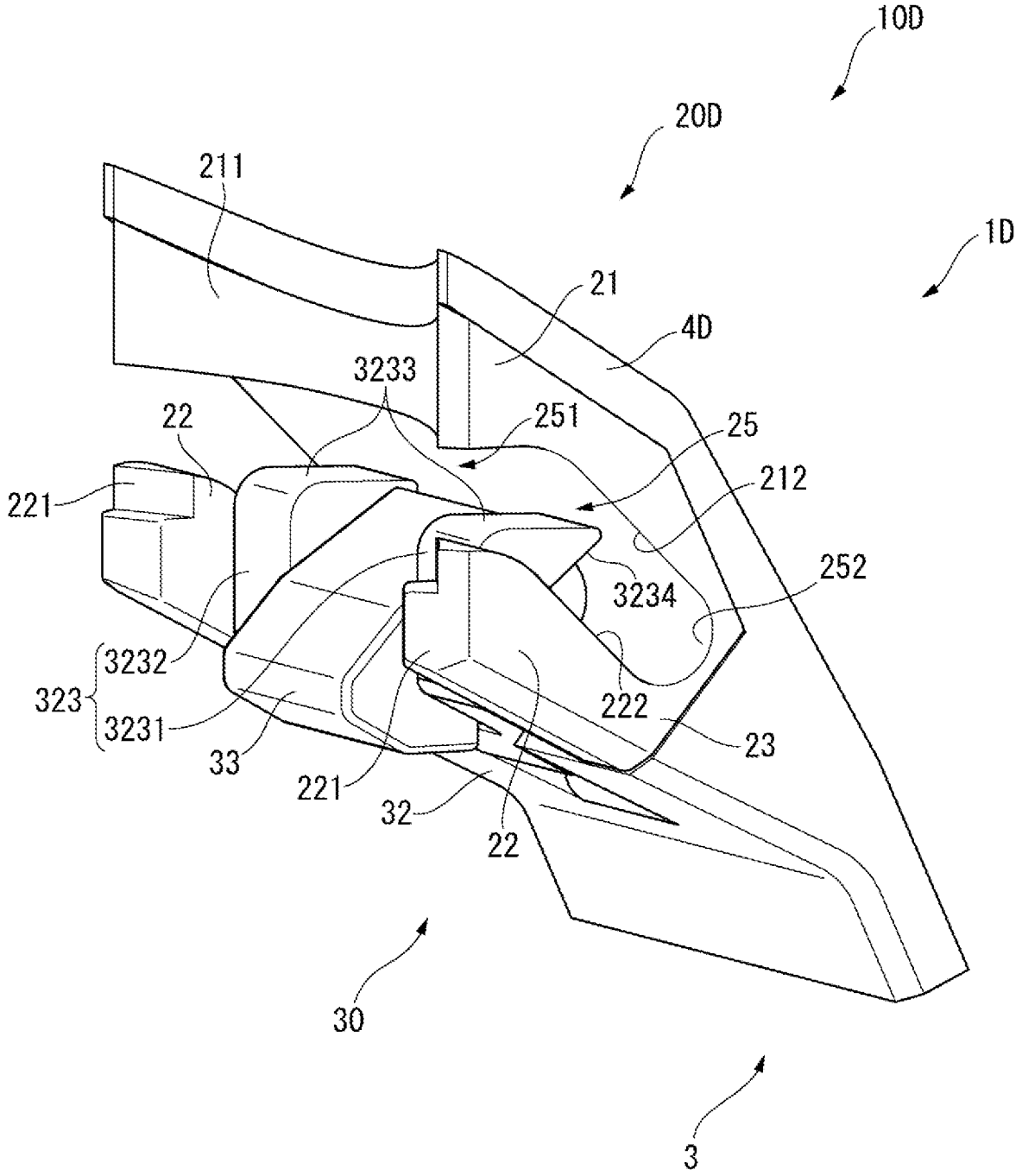
FIG. 13 is a perspective view illustrating a coupler of the fifth embodiment.

FIG. 13 is a cross-sectional view schematically illustrating a coupler 10D according to the fifth embodiment.

As illustrated in FIG. 13, the surface member 4D is affixed to cover the surface of the coupler body member 20D and the band body 3. The surface member 4D is composed of a synthetic resin, leather, or the like, and is formed with non-illustrated irregular portions, patterns, and the like.

Note that the surface member 4D is not limited to being affixed to the coupler body member 20D and the band body 3, and may be provided by insert molding, for example.

Advantageous Functions and Effects of Fifth Embodiment

According to the fifth embodiment thus described, the following advantageous effects can be provided.

In the fifth embodiment, the surface member 4D is affixed to cover the surfaces of the coupler body member 20D and the band body 3. Accordingly, the materials, surface shapes, and the like of the surface member 4D are selected to vary the designs.

Modification Examples

Note that the present disclosure is not limited to the embodiments described above, and variations, modifications, and the like within the scope in which the object of the present disclosure can be achieved are included in the present disclosure.

In the first embodiment described above, the pin 113 is biased, but not limited to, due to the elastic force of the second elastic member 35. For example, the second elastic member 35 may not be provided. In this case, a stopper to make the base end member 32 fixed at the fixing position may be provided.

In the third embodiment described above, the pin 113 is biased, but not limited to, due to the elastic forces of the second elastic member 35B and the lever member 33B. For example, the pin 113 may be biased solely due to the elastic force of the lever member 33B. In this case, a stopper to make the lever member 33B fixed at the fixing position may be provided.

In the first embodiment described above, the guide portion 323 is provided at the base end member 32, however, the guide portion 323 may not be provided without being limited thereto. In this case, the wearer, when causing the pin 113 to be inserted into the guide groove 25, operates the operation portion 334 to depress the lever member 33, to thus move the fixing member 30 to the attaching-detaching position.

In the embodiments described above, the fixing members 30, 30A, 30B, and 30C, but not limited to, are pivotally attached between the fixing position and the attaching-detaching position, to the coupler body member 20, 20A, 20B, 20C, and 20D. For example, the fixing member may be slidably attached to the coupler body member between the fixing position and the attaching-detaching position. In this case, a rail member for causing the fixing member to slide may be provided at the coupler body member.

In the embodiments described above, the first contact face 211 and the second contact face 221 are formed to be abuttable against, but not limited to, the side face 118 of the case 111, which forms the attachment face. For example, a step may be provided at the pair of holding pieces 112A and 112B, where the first contact face 211 and the second contact face 221 may be formed to be abuttable against a face provided at the step. In this case, the face of the step that abuts against the first contact face 211 and the second contact face 221 forms the attachment face. Further in this case, a gap may be created between the side face 118 of the case 111, and the first contact face 211 and the second contact face 221.

In the embodiments described above, the pin 113 is attached to, but not limited to, the lug 112. For example, the pin 113 may be integrally provided with the case 111.

Similarly, the elastic pin 119C may be integrally provided with the case 111.

In the embodiments described above, the watches 100, 100A, 100B, and 100C, and the bands 1, 1A, 1B, 1C, and 1D are exemplified as the wrist-worn device, but the present disclosure is not limited thereto. For example, the present disclosure can be applied to wrist-worn device such as a pulse meter, and to a band attachable to the wrist-worn device.

What is claimed is:

1. A band to be attached to a wrist-worn device body including a case, a lug provided at a side face of the case, a pin supported by the lug, and an attachment face, the band comprising:

a band body;

a coupler body member coupled to an end portion of the band body, the coupler body member being provided with a contact face abuttable against the attachment face and a guide groove into which the pin is insertable; and a fixing member attached to the coupler body member to be movable between:

a fixing position for biasing the pin, inserted into the guide groove, in a direction away from the attachment face to fix the coupler body member onto the wrist-worn device body, and an attaching-detaching position for enabling insertion of the pin into the guide groove and detachment of the pin inserted into the guide groove, the fixing member being attached pivotally in a first direction from the attaching-detaching position toward the fixing position and in a second direction from the fixing position toward the attaching-detaching position, the fixing member including:

a base end member to be pivotally attached to the coupler body member;

a lever member pivotally attached to the base end member and biasing the pin;

a first elastic member configured to bias the lever member to pivot in the first direction, the lever member being configured to bias the pin with an elastic force of the first elastic member;

a second elastic member configured to bias the base end member to pivot in the first direction; and wherein the fixing member is configured to avoid contact with the case when the fixing member pivots between the attaching detaching position and the fixing position.

2. The band according to claim 1, wherein the attachment face includes the side face.

3. The band according to claim 1, wherein the base end member includes a guide portion biased by the second elastic member to come in contact with the coupler body member in a state where the pin is not inserted into the guide groove, the guide portion includes an abutting face that abuts against the pin inserted through an opening of the guide groove into the guide groove in a state where the guide portion is in contact with the coupler body member, and the abutting face is inclined with respect to an insertion direction of the pin such that the base end member pivots in the second direction when the pin is further inserted into the guide groove in a state where the pin abuts against the abutting face.

4. The band according to claim 3, wherein the base end member includes a bearing portion into which a first shaft member that rotatably supports the base end member with respect to the coupler body member is inserted, and a coupling portion extending along an axial direction of the first shaft member, the guide portion includes a first guide portion and a second guide portion provided at a first end side and a second end side of the coupling portion and extending in a direction orthogonal to the axial direction of the first shaft member, and the lever member is disposed between the first guide portion and the second guide portion.

5. The band according to claim 1, wherein the fixing member includes the lever member pivotally attached to the coupler body member and configured to bias the pin, the fixing member includes a third elastic member configured to bias the lever member to pivot in the first direction, and the lever member is configured to bias the pin with an elastic force of the third elastic member.

6. The band according to claim 1, wherein the fixing member includes the lever member pivotally attached to the coupler body member and configured to bias the pin, and the lever member is elastically deformable when coming in contact with the pin at the fixing position to bias the pin with an elastic force of the lever member.

7. The band according to claim 1, comprising a surface member attached to a surface of the coupler body member.

8. A wrist-worn device comprising:

a wrist-worn device body including a case, a lug provided at a side face of the case, a pin supported by the lug, and an attachment face;

a band body attached to the wrist-worn device body;

a coupler body member coupled to an end portion of the band body, the coupler body member being provided with a contact face abuttable against the attachment face and a guide groove into which the pin is insertable; and a fixing member attached to the coupler body member to be movable between:

a fixing position for biasing the pin, inserted into the guide groove, in a direction away from the attachment face to fix the coupler body member onto the wrist-worn device body, and an attaching-detaching position for enabling insertion of the pin into the guide groove and detachment of the pin inserted into the guide groove, the fixing member being attached pivotally in a first direction from the attaching-detaching position toward the fixing position and in a second direction from the fixing position toward the attaching-detaching position, the fixing member including:

a base end member to be pivotally attached to the coupler body member;

a lever member pivotally attached to the base end member and biasing the pin;

a first elastic member configured to bias the lever member to pivot in the first direction, the lever member being configured to bias the pin with an elastic force of the first elastic member;

a second elastic member configured to bias the base end member to pivot in the first direction; and wherein the fixing member avoids contact with the case when the fixing member pivots between the attaching detaching position and the fixing position.

* * * * *